US005261432A

United States Patent [19]

Sandrin

[11] Patent Number: 5,261,432

[45] Date of Patent: Nov. 16, 1993

[54] DISHWASHING MACHINE WITH MULTIDOSE DISPENSER OF POWDER DETERGENT

[75] Inventor: Gianni Sandrin, Pordenone, Italy

[73] Assignee: RO-SA Micromeccanica S.n.c., Venice, Israel

[21] Appl. No.: 974,002

[22] Filed: Nov. 9, 1992

Related U.S. Application Data

[63] Continuation-in-part of Ser. No. 769,824, Oct. 2, 1991, abandoned.

[30] Foreign Application Priority Data

Oct. 3, 1990 [IT] Italy ..... 45758 A/90
Feb. 5, 1992 [IT] Italy ..... PN92 U 000003

[51] Int. Cl.[5] ..... A47L 15/44
[52] U.S. Cl. ..... 134/93; 222/451
[58] Field of Search ..... 134/93; 68/17 R; 222/449, 450, 451, 452, 481, 651, 652

[56] References Cited

U.S. PATENT DOCUMENTS 2,287,216 6/1942 Williams ..... 222/452 X
3,083,717 4/1963 Bear ..... 222/450 X
3,220,607 11/1965 Seal ..... 134/93 X
3,233,782 2/1966 Ullman, Jr. et al. ..... 222/651
3,411,671 11/1968 Harvey et al. ..... 222/652
3,650,439 3/1972 Shimooka ..... 222/450 X
3,827,600 8/1974 Janke ..... 134/93 X

*Primary Examiner*—Philip R. Coe
*Attorney, Agent, or Firm*—Wenderoth, Lind & Ponack

[57] ABSTRACT

A dishwashing machine, particularly a domestic dishwashing machine, having a washing tank and a door for opening and closing the washing tank, is provided with a housing shell on the inner wall of the door and a reservoir-dispenser assembly detachable from the shell. The reservoir-dispenser assembly contains detergent in powder form and includes a detergent reservoir and a dispenser. The reservoir of the reservoir-dispenser assembly contains a plurality of doses of detergent which are individually and automatically released during each washing cycle. In this way, the dishwashing machine can operate several times in succession without the need for replenishing the detergent. The dispenser can draw any amount of detergent from the reservoir sufficient for various preselected washing programs. The dispenser includes a seat delimiting a metering chamber, and a lid moveable off of and onto the seat to open and close the metering chamber. The lid includes a wiping element which will prevent moist detergent from building up on the end of the seat.

21 Claims, 7 Drawing Sheets

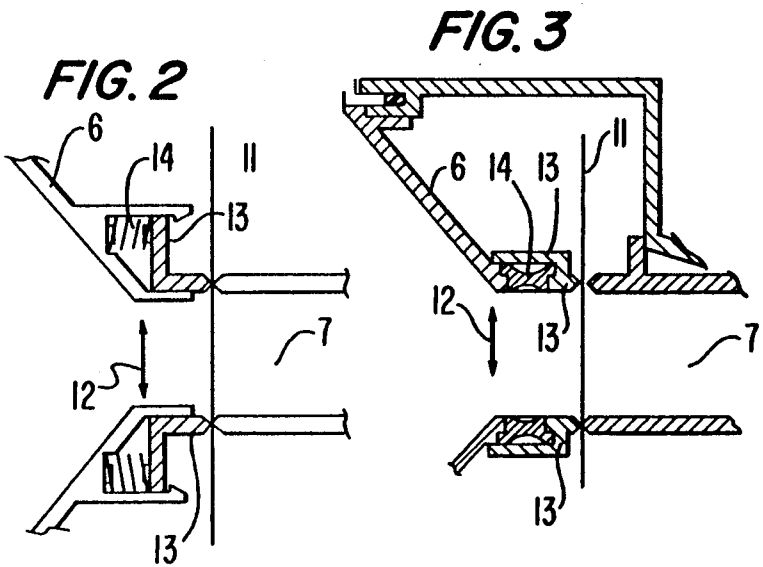
FIG. 3
FIG. 2
6
7
11
12
13
14
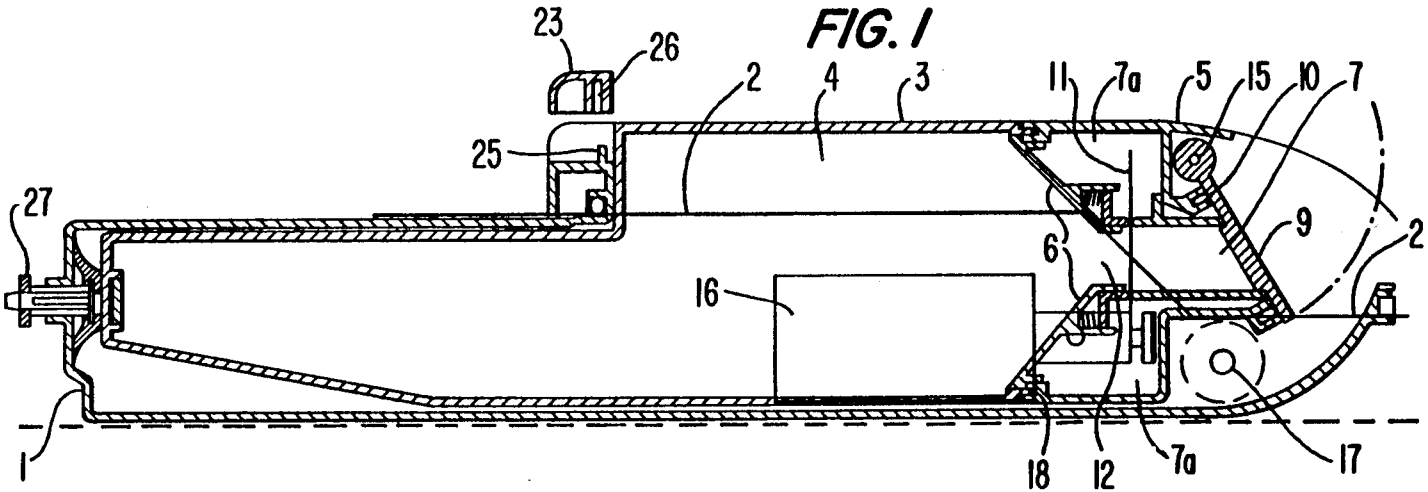
FIG. 1
1
2
3
4
5
6
7
7a
9
10
11
12
15
16
17
18
23
25
26
27

DISHWASHING MACHINE WITH MULTIDOSE DISPENSER OF POWDER DETERGENT

This application is a continuation-in-part of U.S. Ser. No. 07/769,824 filed Oct. 2, 1991 and now abandoned.

BACKGROUND OF THE INVENTION

The current trend toward the use of household electrical apparatus and appliances characterized by automatisms includes the elimination of manual preliminary set-up operations and, in particular, the elimination of those manual operations of filling the dispenser of certain appliances with detergents and other substances every time the appliance has to be used. Specifically, automatic devices now control such filling operations.

At present, dishwashing machines feed the washing tank with powder or liquid detergents by means of a conventional detergent dispenser connected with the tank and divided into various separate and independent compartments each one of them containing a respective detergent.

The different compartments of the dispenser are filled with predetermined doses of powder or liquid detergents which are then directly or indirectly removed from the compartments by water flowing to the washing tank.

The dispensing devices presently employed in the case of powder detergents are of the single-dose type wherein the user, before every washing cycle, must fill a special tray with detergent which then, through a signal command issued by an appropriate control device (programmer), is introduced into the washing tank so as to be dissolved in the washing water.

These devices are rather reliable and simple but they require the user to fill the dispenser before every washing cycle.

Further, the filling operation requires a great amount of attention because the occurrences in which the amount of detergent is incorrect, and often excessive, are quite frequent. Obviously, erroneous amounts of detergent result in a loss of money as well as a greater pollution of the drained water.

Furthermore, when using a dishwashing machine, it is necessary, as a rule, to open its door completely and fill the dispensers located at the inner side of the door. Thus, the user must bend almost down to the floor with a considerable discomfort and also, especially in the case of aged persons, with a great amount of effort.

Washing machines equipped with means for accommodating large amounts of detergents, particularly liquid detergents, are well-known in the art.

These prior art means consist essentially of a plurality of high capacity rigid containers capable of holding liquid substances and connected with the washing tank through respective conduits, the latter being provided with volumetric pumps.

Although these rigid containers satisfactorily dispense liquid detergent or liquid detergent components to the washing tank of the machine, then are so large that, as a rule, they cannot be provided inside the washing machine. Rather, these containers must be disposed outside of the machine.

In fact, washing machines and dishwashing machines in which reservoirs of liquid substances are provided outside of the machine, preferably as assembled together as a container disposed side-by-side with the machine, are well-known in the prior art.

The height and depth of such prior art containers correspond, as a rule, to those of the machine itself so as to comply, at least in part, with the existing dimensional standards.

However, this type of detergent dispenser has two disadvantages. First of all, it takes up additional room which is limited, especially in modern houses. Secondly, it requires the use of detergents in liquid form which, at the present time, are still less effective and more polluting than detergents in powder form.

Further, each of the different washing programs, set by the manufacturer, may typically call for different amounts of detergents, and such "to size" dosage is not obtainable with the current single-dose detergent dispensers.

SUMMARY OF THE INVENTION

Therefore, it is desirable and it is an object of the present invention to provide a dishwashing machine equipped with a powder detergent reservoir which makes it possible both to operate during several consecutive washing cycles without being replenished and to deliver single doses of detergent into the washing tank during the washing cycle, the amount of the doses being in accordance with the preselected washing program.

This object is attained by means of a simple, easy-to-use, reliable and economic integrated device installed in a removable manner inside a dishwashing machine. The integrated device functions as both a multidose reservoir and a dispenser of detergent in powder form.

Another object of the present invention is to provide a device of the type mentioned above which will not readily clog with moistened detergent during prolonged use. This object is attained by providing the detergent dispenser with a seat defining a metering chamber from which the detergent is dispensed, and a lid of the metering chamber which has a wiping element cooperating with the seat to prevent the build-up of moistened detergent at the end of the seat.

BRIEF DESCRIPTION OF THE DRAWINGS

The invention will be best understood from the following description of a non-limiting example made in connection with the accompanying drawings, in which:

FIG. 1 is a schematic diagram of a detergent reservoir-dispenser according to the invention.

FIGS. 2 and 3 are schematic diagrams of two forms of contact elements of the reservoir-dispenser.

DETAILED DESCRIPTION OF THE PREFERRED EMBODIMENTS

The automatic powder detergent dispenser includes a shell 1, inserted into an opening and screwed and gasketed to the inner wall of the door 2 of the dishwashing machine, and a reservoir-dispenser 3 inserted into the shell 1 in such a way as to allow the user to slide it out for an easy replenishment of detergent as will be explained later on.

The reservoir-dispenser 3, removable from the shell 1 by the user, is detachably fixed to the shell 1 by means of a handle 22 (FIGS. 8 and 9) which also functions to lock the reservoir-dispenser 3 in place.

Figure 8:
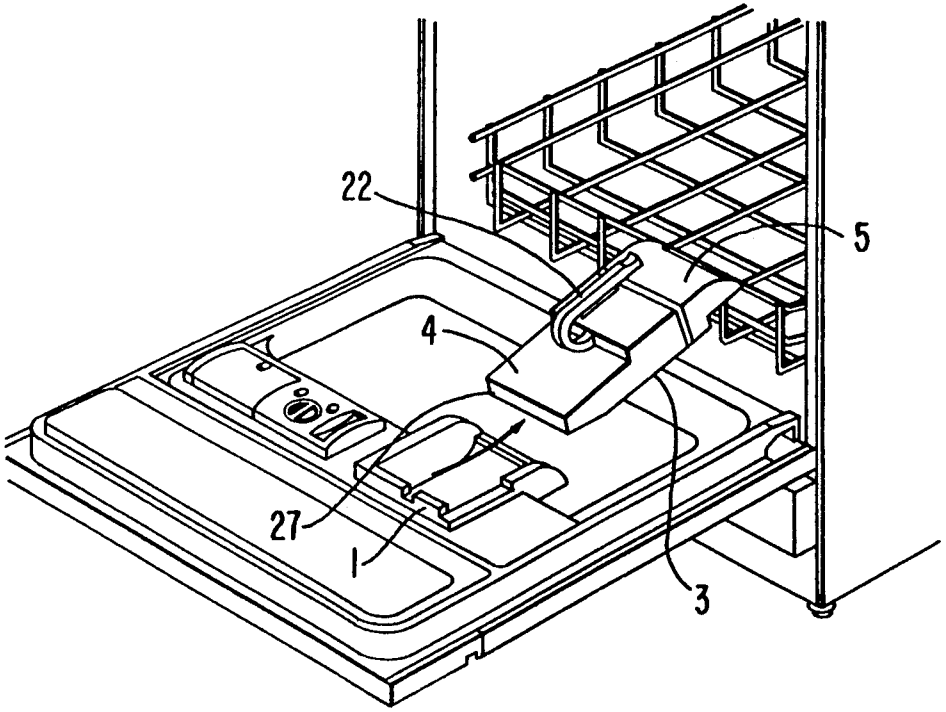
FIG. 8 illustrates the reservoir-dispenser extracted from the door of the dishwasher.
Figure 9:
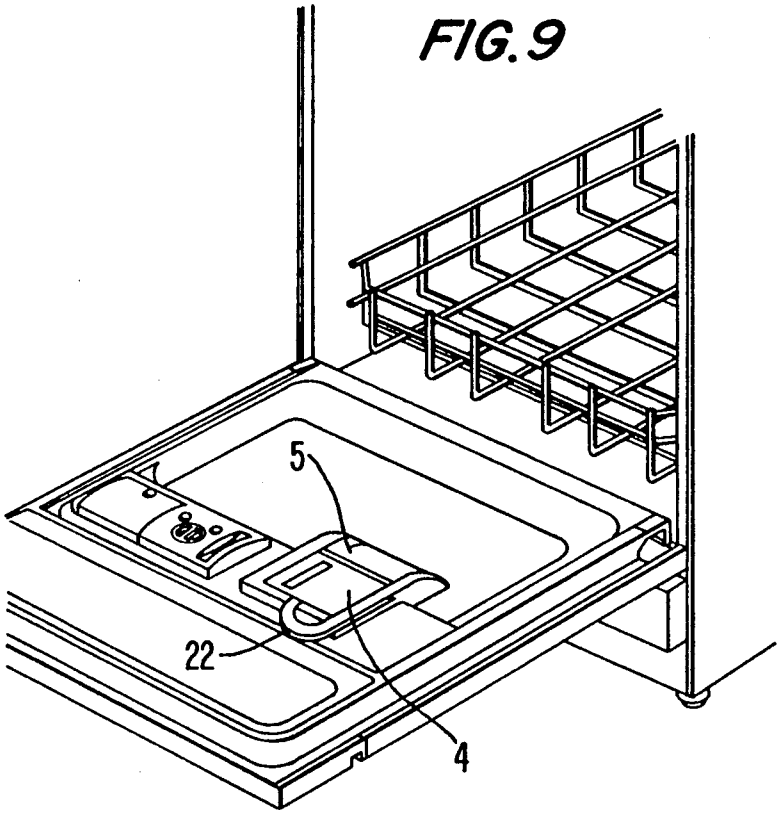
FIG. 9 illustrates the reservoir-dispenser inserted into and engaged with the door of the dishwasher.

When the reservoir-dispenser 3, essentially "L"-shaped as illustrated in FIG. 1, is inserted into the shell 1 and the door is closed, its upper part cannot be lapped by the water, as illustrated in FIGS. 8 and 9.

This embodiment, which advantageously limits the area of direct exposure to the water, thus reduces the possibility of water seepage and maintains a lower average temperature inside the detergent dispenser which enhances detergent preservation.

The lower part of the reservoir-dispenser 3, corresponding to the base of the "L", houses the detergent. When the door is closed, the lower part of the reservoir-dispenser extends in a downward direction so that the detergent can be fed by gravity into the washing tank.

The reservoir of the reservoir-dispenser, which consists of a box-like hollow body 4, can be filled with an amount of detergent sufficient for numerous washing cycles.

The lower part of the reservoir is connected with the dispenser 5 of the reservoir-dispenser. The dispenser 5 is provided with a feedbox 6 which receives the detergent from the reservoir and conveys it to a predetermined-volume container or metering chamber 7.

A first separating element 8, placed between the reservoir feedbox 6 and the metering chamber 7, can slide transversely and hence preclude or enable the passage of the detergent in powder form into the metering chamber 7.

The end of the metering chamber 7, positioned toward the washing tank, is hermetically closed by means of a hinged movable lid 9 which, when swung closed, lies flat on a seat provided with a well-dimensioned water-tight gasket 10.

The purpose of the gasket 10 is to prevent water from leaking into side compartments 7*a* of the chamber 7 and thus clogging the compartments and impairing their function.

These compartments 7*a*, as shown in FIG. 1, first collect the detergent occasionally strained out from the separating element 8 and then discharge the detergent into the washing tank when the movable lid 9 swings open.

The coupling between the box-like hollow body 4 and the dispenser 5 can be assured by a spring-lock restrained joint 18 or by an equivalent means, capable of assuring a perfect seal.

The first separating element 8 consists of a movable very flat perforated lamina 11, preferably a thin chrome-nickel steel diaphragm, disposed over the aperture 12 of the metering chamber 7. The aperture 12 and the perforation of the movable lamina 11 are identical and coincident so that the passage between the feedbox 6 and the metering chamber 7 can be opened by sliding the movable lamina 11 relative to the aperture 12.

A distinctive feature of the device is the special configuration of the contact zone between the sliding diaphragm and the rims of the reservoir-dispenser 3 defining the apertures of both the feedbox 6 and metering chamber 7.

In fact, the hermetic contact of the movable perforated lamina 11 with the rims defining the apertures of both the feedbox 6 and metering chamber 7 is assured by contact parts 13 defining a peripheral knife-like edge. These parts 13 can move perpendicularly to the inlet of the metering chamber 7 and are elastically mounted to the outlet of the feedbox 6 so as to uniformly contact the lamina 11 and preclude the passage of detergent therebetween.

The pressure necessary for establishing the required seal at the contact parts 13 is, preferably, created by a plurality of springs 14 acting on the parts 13.

FIGS. 2 and 3 are respective enlarged views of the contact zone. Instead of coil springs 14, an elastomeric spring 14 is compressed between the movable contact parts 13 and the feedbox 6 (FIG. 3).

The movable lamina 11 and movable lid 9 are simply and easily moved by conventional techniques employed for the actuation of mechanical elements.

The lamina 11 and lid 9 are actuated, preferably, by means of the rotary motion of shafts, cams, pins or other equivalent driving mechanisms 15 on which they are keyed.

The actuation of the elements are timed so that when the detergent has to be released into the washing tank, the lamina 11, normally open, closes before the movable lid 9 opens and, conversely, after said detergent has been released, the movable lid 9 closes before the lamina 11 opens.

Figure 4:
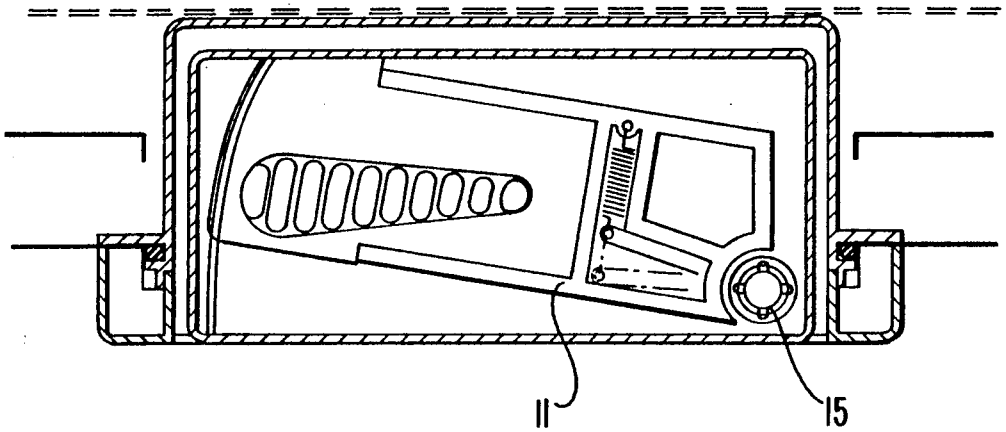
FIGS. 4 and 5 are schematic diagrams of two forms of a perforated lamina of the same.
Figure 5:
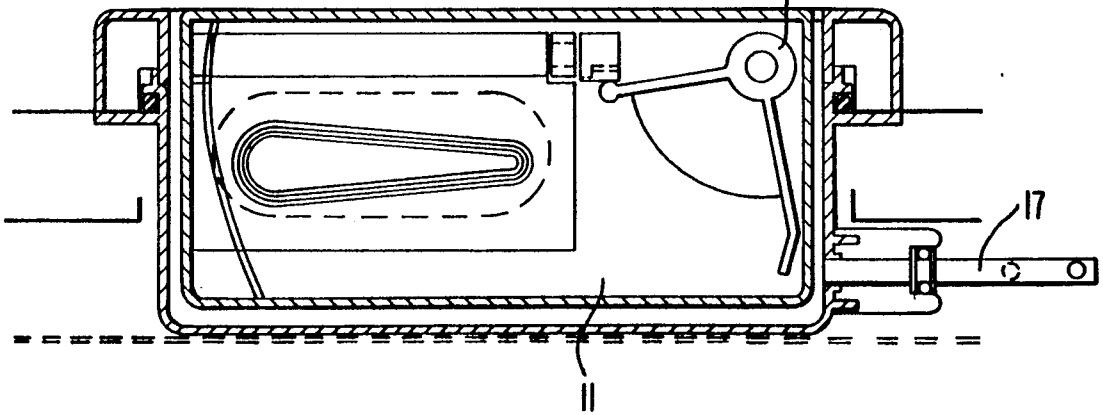
Figure 6:
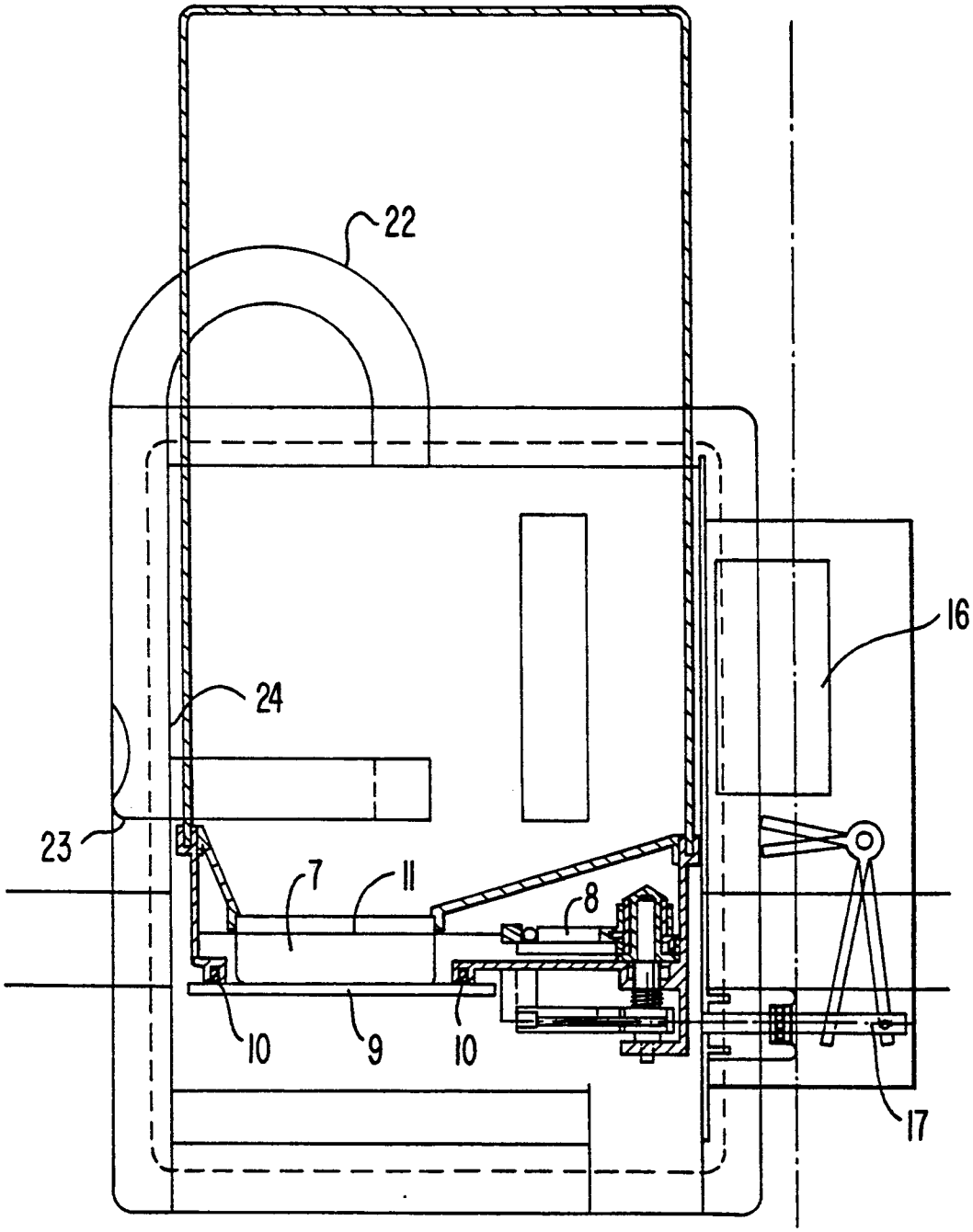
FIG. 6 is a schematic diagram of a handle for locking and unlocking the reservoir-dispenser to a door of the dishwasher.

The driving mechanisms 15, which transmit motion to the movable perforated lamina 11 and to the movable lid 9, are driven by an actuator 16, mounted outside the shell 1 on the inner side of the door. The mechanisms 15 are acted on by one or more pin-like elements 17 which are part of the actuator 16, as shown in FIGS. 1 and 5.

It is evident that when the actuator is in a stop motion state, the elements 17 are set inwardly inside the shell 1 and can engage the mechanisms 15 through appropriate openings formed in the wall of the shell 1.

Despite the provision of gasket 10 at the end of the seat defining the metering chamber, when the movable lid 9 is opened a film of humidity may in fact form on the inside surfaces of the seat and on the terminal edge thereof on which the movable lid 9 rests.

That is, upon prolonged use, i.e. successive openings of the movable lid 9, the powdered detergent may contact the lower edge of the seat, thereby forming dense clots of moistened detergent.

Because this effect tends to progressively increase, a halo of moist detergent may form at the end of the metering chamber 7, i.e. the terminal end of the seat. In this case the following problems arise. On the one hand, the lid 9 no longer covers the metering chamber 7 sufficiently so that there is an undesirable outflow of detergent into the washing tank before the time intended, resulting in a loss of efficacy of the washing cycle. On the other hand, this clot tends to prevent the lid 9 from moving toward the seat, thus obstructing its complete closing and the correct functioning of the control mechanism.

Thus, in a second embodiment shown in FIGS. 11–15, the lid 9 and seat 8 defining the metering chamber 7 are designed to ensuredly prevent the build-up of moistened detergent at the end of the metering chamber 7.

With reference to the figures, similar to the first embodiment, the seat 8 delimits the metering chamber 7, and the lid 9 is pivotably mounted in the dispenser so as to close the metering chamber. Specifically, a main body 9*a* of the lid rests on the terminal edge of seat 8 when the lid is in a normal position thereof. Preferably, the main body 9*a* is of elastromeric material.

A thin, preferably flexible wiping element 115 such as a thin metalic sheet, is spaced a slight distance from the inner surface of the main body 9*a* of the lid by means of a support 116 of the lid. The outer peripheral portion of the wiping element 115 is supported by the tips of bracing elements 117.

The outer periphery of the wiping element 115 has a shape complimentary to but smaller than that of the main body 9*a* of the lid for reasons which will be described in detail later on.

Figure 13:
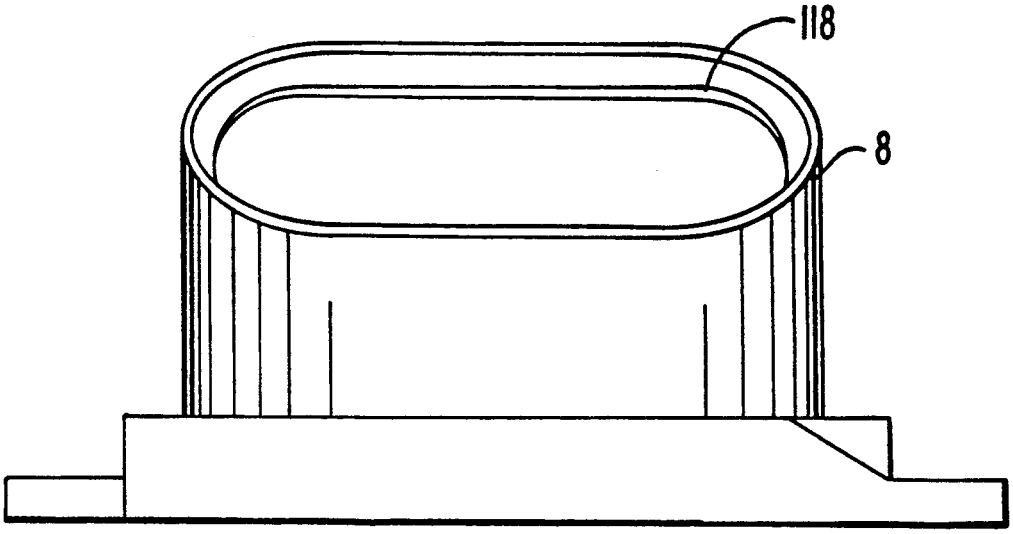
FIG. 13 is a front view of a seat defining the metering chamber of the dispenser of the second embodiment.
Figure 14:
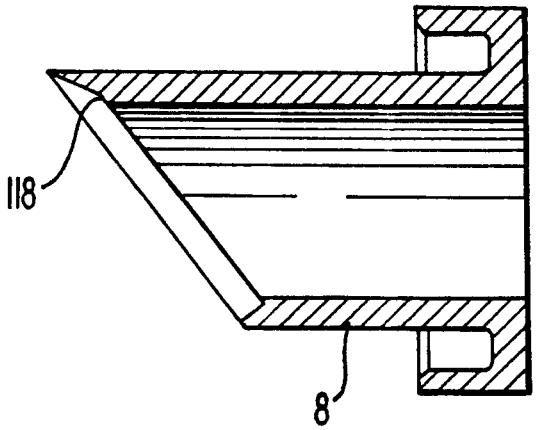
FIG. 14 is a longitudinal sectional view of the seat shown in FIG. 13.
Figure 15:
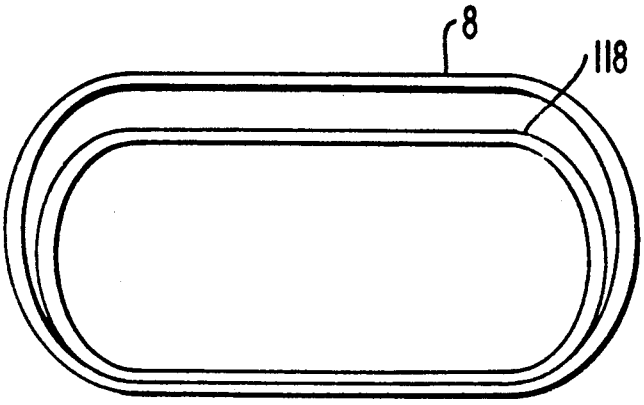
FIG. 15 is a plan view of the seat shown in FIG. 13.

Referring now to FIGS. 13–15, as in the first embodiment, the terminal edge of the seat 8 generally lies in a plane inclined (oblique) relative to the longitudinal axis of the metering chamber 7. The inner surface of seat 8 has a stepped portion 118 adjacent the terminal edge thereof. As shown in FIGS. 13–15, this stepped portion includes a first annular surface extending generally radially of the longitudinal axis of the metering chamber but which surface lies in a plane parallel to that in which the terminal edge of the seat 8 lies. A second annular surface extends between the first annular surface and the terminal edge of the seat 8. The second surface is generally frustoconical so that the space bounded by the second annular surface becomes wider in a direction towards the terminal edge of the seat 8. The spacing between the first annular surface and the terminal edge of the seat 8 corresponds to that between the wiping element 115 and the main body 9*a* of the lid 9.

Thus, when the lid 9 is in the closed normal position thereof, the wiping element 115 is seated on the first annular surface of the stepped portion of the seat 8, whereas the main body 9*a* is seated on the terminal edge of the seat 8. Thus, the metering chamber 7 is hermetically sealed by the "double closure" provided by the preferably flexible wiping element 115 and the preferably elastomeric main body 9*a* of the lid 9.

The wiping element prevents the build-up of moist detergent at the terminal edge of the seat 8 because, as the lid 9 is pivoted to its normal closed position, the outer periphery of the wiping element 115 will cut into any significant clot of moistened detergent adhering to the seat 8 at the terminal edge thereof. The seat 8 is thus wiped clean of such moistened detergent after each dispensing operation at which time the lid 9 is brought back to its normal position over the metering chamber 7 and the wiping element 115 is inserted into the seat to come to rest on the first annular surface of the stepped portion 118.

The wiping element will become more effective with increases in the force by which the lid 9 is moved to the normal closed position thereof. Therefore, according to another feature of the second embodiment of the present invention, means are taken to move the lid 9 onto the seat 8 with a great amount of force, particularly during the final phase of the movement thereof in which the wiping element is required to cut into any moistened detergent adhering to the seat 8.

Figure 11:
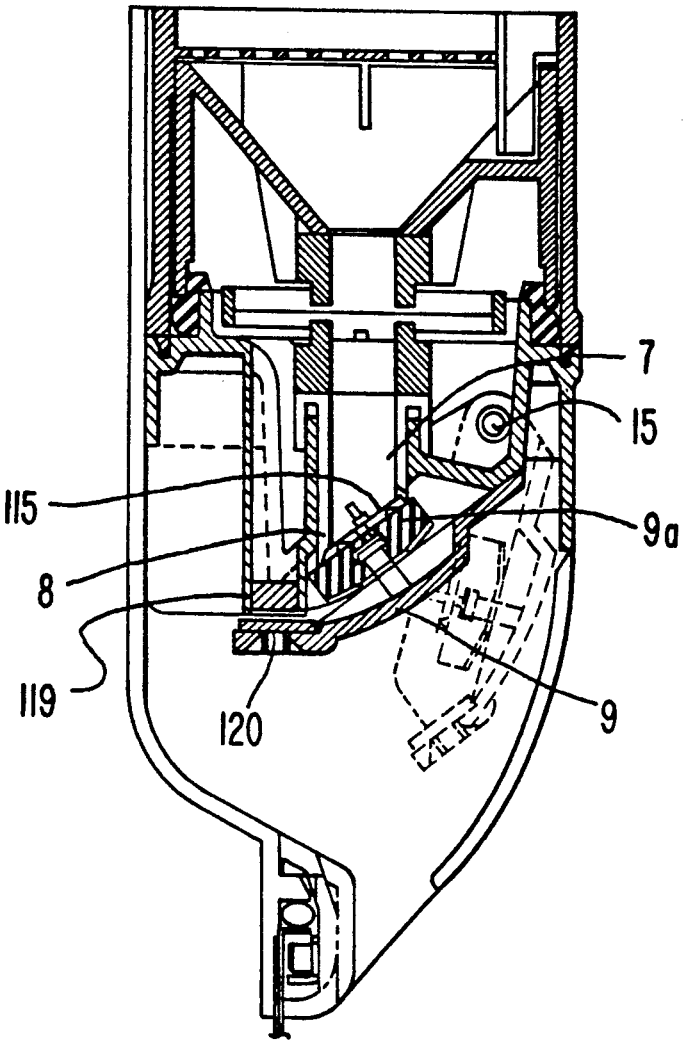
FIG. 11 is a sectional view of a portion of a second embodiment of the reservoir-dispenser according to the present invention.
Figure 12:
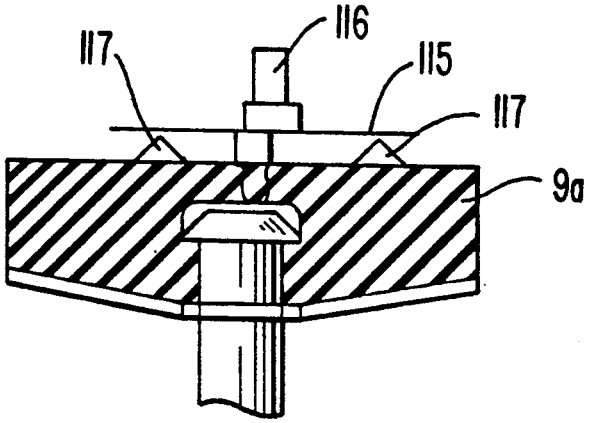
FIG. 12 is an enlarged view of a section of the lid of the dispenser of the second embodiment shown in FIG. 11.

Specifically, one or more permanent magnets 119 are provided in the dispenser preferably adjacent the end of the metering chamber 7, as shown in FIG. 11. Magnetic element(s) 120 are mounted to the lid 9 at a position thereon which will place the magnetic element(s) adjacent the magnet(s) 119 when the lid 9 is closed. That is, as the lid 9 is pivoted closed, the magnetic element(s) 120 approaches the magnet(s) 119, whereby the mutual attraction of these magnetic element(s) 120 and magnet(s) 119 cause the lid 9 to be snapped closed with a great deal of force thus increasing the effectiveness of the wiping element 115. Of course, the arrangement of the permanent magnet(s) 119 and magnetic element(s) 120 can be reversed.

The lid 9 can be obtained by any of various known driving mechanisms 15 capable of overcoming the force of mutual attraction between the magnet(s) 119 and magnetic element(s) 120. For instance, a suitable cam may be provided as a constitutent of the driving mechanism whereby the profile of the cam ensures that the necessary force is generated when initially moving the lid 9 off of the seat 8. Such initial movement will be slow while the subsequent movement will be faster as the resistance offered by the magnet(s) 119 will progressively decrease with such movement.

Now, the use of the present invention, as a whole, will be described.

To fill the reservoir with detergent, the user disengages and slides the reservoir-dispenser 3, in a combined outward-upward direction, out of the housing shell 1 and away from the actuator 16.

In this way, the device can be placed on a table and filled with detergent in powder form.

To replenish the detergent, it is sufficient to disengage the joint 18, disjoin the reservoir from the dispenser 5, and then fill the reservoir with detergent. After this filling operation, the reservoir is joined again with the dispenser and the reservoir-dispenser 3 is then re-inserted into shell 1 inside the dishwashing machine.

When detergent has to be supplied to the dishwashing machine, the actuator 16 unseats the pin 17 thus actuating the driving mechanisms 15 which slide the lamina 11 closed and swing the lid 9 open.

More specifically, the sequence of operations take place as follows:

Sliding closed of lamina 11 and hence closing of the passage extending into the metering chamber 7;

Swinging open of lid 9 and hence dispensing the detergent into the washing tank;

Swinging closed of lid 9;

Sliding open, in a rest position, of lamina 11 and hence replenishment of the detergent dose in the metering chamber 7.

During the above-described operation sequence, the washing pump is stopped in order to prevent water from being sprayed into the device. The detergent is supplied to the washing tank every time the appropriate electrical actuator 16 is energized by the programmed control unit of the dishwashing machine.

The actuator 16 acts on the movable lamina 11 as well as on the movable lid 9 in accordance with the above-described operation sequence, i.e. first, the detergent already in the metering chamber falls into the washing tank, then, the movable lid swings closed and, finally, the movable lamina slides open so to allow the metering chamber to be replenished with the required amount of detergent.

An advantageous feature of this device, as shown in the drawings, resides in the movable lid 9 being oblique with respect to the longitudinal axis of the metering chamber 7. In fact, with this arrangement it is possible to swing the movable lid 9 open by means of a minimal rotation of the shaft (driving mechanism) 15 on which the movable lid is keyed. Thus, a simple driving mechanism may be employed.

As a matter of fact, if the lid 9 were arranged perpendicularly with respect to the longitudinal axis of the metering chamber 7, in order to swing the movable lid open, it would be necessary to rotate the lid over a complete right angle which is a relatively complex operation.

It is evident that it is possible to adjust the amount of detergent to be supplied into the washing tank at every washing cycle, simply by issuing appropriate control commands to the actuator with the programmed control unit.

A further advantage of this device resides in a special engaging and locking handle 22.

The handle 22 is rotatably mounted on that part of the dispenser facing the washing tank. Rotary motion of the handle is controlled by a counteracting spring (not shown). The counteracting spring, when in its rest position, urges the handle 22 into a recess provided in the shell 11, as shown in FIGS. 8 and 9.

The handle 22 advantageously locks the reservoir-dispenser 3 in place once the latter is inserted into the shell 1. A pin-like or plate-like shaped tongue 25 is fixed at the inner wall of the door in correspondence with a protruding element 23 of the base 24 of the handle. A recess 26, coincident with the tongue 25, is provided in the protruding element 23 so that when the handle is rotated outwardly against the force of the counteracting spring, the recess 26 is moved off of tongue 25 and when the handle is released, the tongue 25 is received by the recess 26.

Conversely, to slide the reservoir-dispenser 3 out of the shell 1, the user performs a reverse operation sequence which is not described here for the sake of brevity.

Next, due to both the progressive emptying of the reservoir and the rapid cooling of the dispenser wall facing the washing tank during both the pre-washing cycles and cold water circulation, a vacuum may occur inside the reservoir which could impair the regular and accurate filling of the metering chamber 7.

Figure 7A:
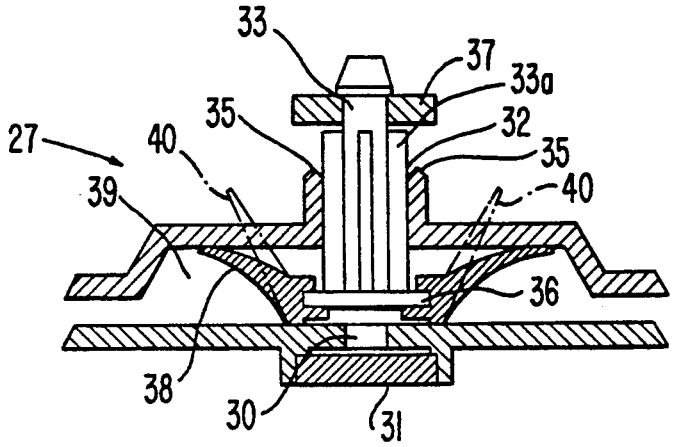
FIGS. 7(*a*) and 7(*b*) are schematic diagrams of a pressure release valve of the reservoir-dispenser.
Figure 7B:
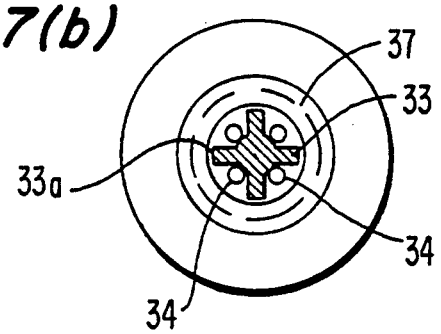
Figure 10:
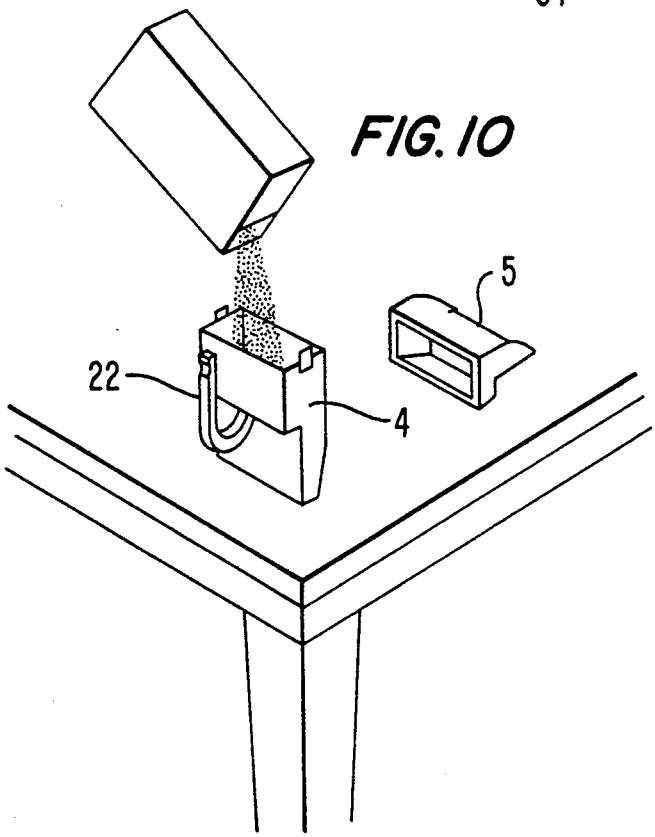
FIG. 10 illustrates a typical method for filling the reservoir-dispenser with detergent in powder form.

To counter such an inconvenience, a compensating air inflow valve is installed at the top 27 of the reservoir, for example as shown in FIGS. 1 and 7(*a*), 7(*b*).

If a conventional valve were employed a movable stem would pass through the top of the reservoir and abut the corresponding upper wall of the housing shell 1. Valve holes would be defined on the top of the reservoir proximate the stem. When the reservoir has to be filled with detergent, the reservoir, as a rule, is placed on a table. In this case, the reservoir would actuate the opening of the valve. Consequently, the valve would immediately become clogged with detergent, thereby losing its effectiveness and damaging the table surface as well.

To avoid such problems, the reservoir is provided with a special valve 27, free of moving parts. The valve 27 has a plug 31 made of a material permeable to air but not to the detergent, such as a sintered material. The plug 31 covers and permanently closes a reservoir vent hole 30 so that the outer surface of the reservoir surrounding the vent hole 30 remains flat.

The corresponding surface of the shell 1 is slightly outwardly convex so as to define a shallow recess. A second hole 32, coaxial with the vent hole 30, extends through an outwardly projecting cylindrical crown 35. A finned pin 33, defining a plurality of longitudinal channels 34 between adjacent fins, extends axially through the second hole 32.

The upper end of the pin 33 is provided with a horizontally disposed closing valve element 37 which can cover the rim of crown 35 and hence close the channels 34. Inside the shell 1, the lower end of the pin 33 is provided with a stop element 36. The reservoir presses the stop element 36 when the reservoir-dispenser 3 is inserted in the shell 1.

The geometry and dimensions of the valve 27 are such that when the reservoir-dispenser 3 is inserted into the housing shell 1, the upper wall of the former abuts the pin 33 and pushes the valve element 37 up thus opening the channels 34.

In short, when the reservoir-dispenser 3 is inserted into housing shell 1, an air passage is automatically opened between the exterior and the interior of the reservoir via the channels 34, the shallow recess defined in the shell, the vent hole 30 and plug 31. The plug 31 allows the inflow of air without, however, being clogged by detergent due to the characteristics of its material.

When the reservoir is being filled with detergent, the plug 31, due to the characteristics of the material from which it is made, cannot be clogged and further, the surface of the reservoir resting on the table during the detergent replenishment is regular and flat.

To prevent humidity and heat emanating from the washing tank from entering the reservoir by passing through the interface 39 existing between the reservoir and the inner wall of the housing shell 1 and then through the vent hole 30, it is advisable to seal the interface by means of an appropriate, resilient lip-type gasket 38, tapered toward the shell as shown in the drawing by dotted line 40. The gasket 38 encloses the stop element 36 so that when the reservoir-dispenser 3 is inserted into the shell 1, the bottom wall of the latter, by pushing against the stop element 36, causes the gasket 38 to contact the convex portion of the shell, thus sealing the interface 39 and hence the inside of the reservoir.

What is claimed is:

1. A dishwashing machine comprising: a washing tank; a door mounted to said tank so as to be movable between an open position at which the tank can be loaded and a closed position, said door having an inner wall facing the interior of the washing tank when said door is in the closed position thereof; a shell-like housing fitted to the inner wall of said door; and a reservoir-dispenser assembly removably inserted in said housing, said reservoir-dispenser assembly including a detergent reservoir and a detergent dispenser detachably mounted to one another, said reservoir having a capacity sufficient to accommodate enough detergent for a plurality of washing cycles of the dishwashing machine, said dispenser having an outlet and dispensing elements operable to meter and dispense single doses of detergent from the reservoir and through said outlet, and the reservoir of said reservoir-dispenser assembly being disposed above said dispenser with the outlet of said dispenser facing downwardly when said door is in the closed position thereof such that detergent dispensed through the outlet of said dispenser will flow into said washing tank.

2. A dishwashing machine as claimed in claim 1, wherein said reservoir-dispenser assembly has a feedbox at the bottom of said reservoir, said dispenser defines a metering chamber therein communicating with said feedbox, and said dispensing elements include a first separating element movable between said feedbox and said metering chamber.

3. A dishwashing machine as claimed in claim 2, wherein said dispensing elements also include a lid covering said metering chamber when in a closed normal position and movable off of said metering chamber, and said metering chamber is directly open to the interior of said washing tank when said door is in the closed position thereof and said lid has been moved off of the metering chamber.

4. A dishwashing machine as claimed in claim 3, wherein said lid extends obliquely to a longitudinal axis of said metering chamber when the lid is in the closed normal position thereof.

5. A dishwashing machine as claimed in claim 3, wherein said dispensing elements include driving mechanisms capable of moving said first separating element to a closed position between said feedbox and said metering chamber before said lid is closed over said metering chamber and is capable of closing said lid to said normal position thereof before the first separating element is moved to an open position placing said feedbox in open communication with said metering chamber.

6. A dishwashing machine as claimed in claim 5, wherein said driving mechanisms include shafts or pins on which said lid and said first separating element are rotatably supported in the dispenser, and said dispensing elements further include at least one actuator operable to rotate said shafts or pins.

7. A dishwashing machine as claimed in claim 2, wherein said metering chamber defines an aperture at an end thereof facing said feedbox, and said first separating element is a thin lamina having a perforated portion of a size corresponding to that of the aperture at the end of said metering chamber such that said feedbox is open to said metering chamber when the perforated portion of said lamina is located therebetween, and said lamina is slidable across said aperture to open and close said metering chamber to said feedbox.

8. A dishwashing machine as claimed in claim 7, wherein said reservoir-dispenser assembly includes a contact part contacting a non-perforated portion of said lamina and providing a hermetic seal therewith, and spring means for biasing said contact part into sealing engagement with said lamina.

9. A dishwashing machine as claimed in claim 1, wherein a tongue is fixed on the inner wall of said door, and said reservoir-dispenser assembly includes a handle defining a recess therein, said handle being biased to a locked position at which said tongue is received in the recess to secure said reservoir-dispenser assembly in position in said housing, and said handle being movable to withdraw said tongue from said recess and disengage said handle from said tongue.

10. A dishwashing machine as claimed in claim 1, and further comprising an air inflow valve at an upper part of said reservoir with respect to when said door is closed, said valve being opened by the insertion of said reservoir-dispenser assembly into said housing.

11. A dishwashing machine as claimed in claim 10, wherein said air inflow valve includes a vent hole extending through said reservoir, a plug within said reservoir and covering said vent hole, said plug being permeable to air and non-permeable to detergent, a convex portion of said shell-like housing forming a shallow recess confronting said vent-hole, said convex portion having a cylindrical crown defining a second hole extending through said convex portion substantially coaxially to said vent hole, a pin extending through said second hole and having a plurality of radial fins defining channels therebetween extending longitudinally of the pin, a closing valve element fixed to an upper end of said pin which projects from said crown, said closing valve element having a diameter greater than that of the inner diameter of said cylindrical crown so as to be seatable thereon to close said channels to the exterior of said shell-like housing, and a stop element connected to a lower end of said pin which projects into said housing, said stop element being in pressing engagement with the upper wall of said reservoir.

12. A dishwashing machine as claimed in claim 11, wherein said air inflow valve further includes a gasket interposed between the upper wall of said reservoir, about the periphery of said vent hole, and the convex portion of said shell-like housing so as to seal an interface between said vent hole and said shell-like housing.

13. A dishwashing machine as claimed in claim 11, wherein said plug comprises a sintered material.

14. A dishwashing machine as claimed in claim 1, wherein said dispenser includes a seat defining a metering chamber therewithin, and said dispensing elements include a lid resting on said seat and covering said metering chamber when in a closed normal position thereof and moveable off of said seat, said seat having a terminal edge at the end thereof and an inner surface having a stepped portion adjacent said terminal edge, said stepped portion including a first annular surface extending generally radially of the longitudinal axis of said metering chamber, and said lid including a main body having an inner surface which rests on the terminal edge of said seat when the lid is in said closed normal position, and a wiping element spaced above the inner surface of the main body of said lid, said wiping element resting against the first annular surface of said lid when the lid is in the closed normal position thereof.

15. A dishwashing machine as claimed in claim 14, wherein said wiping element is flexible and has an outer periphery corresponding to that of said annular surface, said lid includes a support connected to said main body of the lid and to said wiping element and spacing said wiping element above the inner surface of said main body, and bracing elements integral with said main body and supporting said wiping element adjacent the outer periphery thereof.

16. A dishwashing machine as claimed in claim 15, wherein the outer periphery of said wiping element is complementary in shape and size to that of said first annular surface, and the stopped portion of the inner surface of said seat is constituted by a second annular surface extending between said terminal edge and said first annular surface, the second annular surface being frustoconical such that the space within said second annular surface becomes wider in a direction towards said terminal edge.

17. A dishwashing machine as claimed in claim 16, wherein said wiping element is a thin metallic plate.

18. A dishwashing machine as claimed in claim 15, wherein said wiping element is a thin metallic plate.

19. A dishwashing machine as claimed in claim 14, wherein said lid has one of a permanent magnet and a magnetic element mounted thereto, and the other of said permanent magnet and said magnetic element is mounted in the dispenser adjacent the terminal edge of said seat at the end of said metering chamber.

20. A dishwashing machine as claimed in claim 19, wherein said wiping element is a thin metallic plate.

21. A dishwashing machine as claimed in claim 14, wherein said wiping element is a thin metallic plate.

* * * * *